US012077357B2

(12) United States Patent
Olsen

(10) Patent No.: US 12,077,357 B2
(45) Date of Patent: Sep. 3, 2024

(54) FINGER TAB CONTAINER CARRIER

(71) Applicant: ILLINOIS TOOL WORKS INC., Glenview, IL (US)

(72) Inventor: Robert C. Olsen, Medinah, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 98 days.

(21) Appl. No.: 17/640,242

(22) PCT Filed: Oct. 7, 2020

(86) PCT No.: PCT/US2020/054482
§ 371 (c)(1),
(2) Date: Mar. 3, 2022

(87) PCT Pub. No.: WO2021/076364
PCT Pub. Date: Apr. 22, 2021

(65) Prior Publication Data

US 2022/0306363 A1 Sep. 29, 2022

Related U.S. Application Data

(60) Provisional application No. 62/914,704, filed on Oct. 14, 2019.

(51) Int. Cl.
*B65D 71/50* (2006.01)

(52) U.S. Cl.
CPC ..... *B65D 71/504* (2013.01)

(58) Field of Classification Search
CPC ..... B65D 71/504; B65D 5/24; B65D 71/00; B65D 71/50
(Continued)

(56) References Cited

U.S. PATENT DOCUMENTS

| | | | |
|---|---|---|---|
| 2,936,070 | A | 5/1960 | Ougljesa |
| 3,733,100 | A | 5/1973 | Tanzer |

(Continued)

FOREIGN PATENT DOCUMENTS

| | | | |
|---|---|---|---|
| GB | 1525073 | | 9/1978 |
| NL | 7206011 | A | 11/1972 |
| WO | WO 2016/001619 | | 1/2016 |
| WO | WO 2017/192472 | A1 | 11/2017 |
| WO | WO 2019/193344 | A2 | 10/2019 |

OTHER PUBLICATIONS

European Patent Office (EPO), Rijswijk, NL, International Search Report, Form PCT/ISA/210 for International Application No. PCT/US2020/054482, dated Apr. 14, 2021 (6 pp.).

(Continued)

*Primary Examiner* — Steven A. Reynolds
(74) *Attorney, Agent, or Firm* — Pauley Erickson & Swanson

(57) ABSTRACT

A container carrier for unitizing a plurality of containers that includes a plurality of flexible bands forming an array of container receiving apertures, the array arranged in longitudinal rows and transverse ranks. A generally rectangular shaped intermediate aperture is formed between each pair of container receiving apertures, wherein at least two sides of the intermediate aperture are concave, forming convex tabs protruding inward to the intermediate apertures. The resulting carrier is capable of unitizing a variety of containers in a tight multipackage with finger tabs to make carrying the multipackage much easier.

15 Claims, 4 Drawing Sheets

(58) Field of Classification Search
USPC ..... 206/147, 145, 150, 139, 151, 148, 149
See application file for complete search history.

(56) References Cited

U.S. PATENT DOCUMENTS

| | | | | |
|---|---|---|---|---|
| 3,946,535 | A | 3/1976 | Bourgeois et al. | |
| 4,462,494 | A | 7/1984 | Cunningham | |
| 7,775,348 | B2 * | 8/2010 | Olsen | B65D 71/504 294/87.2 |
| 7,793,778 | B2 * | 9/2010 | Olsen | B65D 71/504 294/87.2 |
| 10,301,092 | B2 * | 5/2019 | Olsen | B65D 71/504 |
| 2019/0276211 | A1 * | 9/2019 | Olsen | B65D 71/504 |

OTHER PUBLICATIONS

European Patent Office (EPO), Rijswijk, NL, Written Opinion of the Int'l Searching Authority for Int'l AppIn No. PCT/US2020/054482, Form PCT/ISA/237, dated Apr. 14, 2021 (7 pp.).
EPO (Munich, DE), Office Action for European Patent Application No. 20797922.0, dated Oct. 7, 2020 (12 pages).
WaveGrip carrier, www.Twitter.com/www.wavegrip.com, Mar. 7, 2017, (9 pages).
EPO (Rijswijk, NL), EPO Form 2001 "Communication pursuant to Article 94(3) EPC (Office Action)," for European Patent Application No. 20797922.0, Issued Apr. 8, 2024 (4 pp.).

* cited by examiner

FINGER TAB CONTAINER CARRIER

CROSS REFERENCE TO RELATED APPLICATION

This application is a National Phase filing of PCT International Patent Application Number PCT/US2020/054482, filed on 7 Oct. 2020, which claims the priority of U.S. Provisional Patent Application Ser. No. 62/914,704, filed 14 Oct. 2019.

These applications are hereby incorporated by reference herein in their entirety and is made a part hereof, including but not limited to those portions which specifically appear hereinafter.

BACKGROUND OF THE INVENTION

Field of the Invention

This invention relates to a finger tab container carrier having container receiving apertures for unitizing a plurality of containers.

Description of Prior Art

Conventional container carriers are often used to unitize a plurality of similarly sized containers, such as cans, bottles, jars and boxes and/or similar containers that require unitization. Flexible plastic ring carriers are one such conventional container carrier.

Flexible plastic ring carriers having a plurality of container receiving apertures, typically of an oval, round or rectangular configuration, that each engage a corresponding container, may be used to unitize groups of four, six, eight, twelve or other suitable groups of containers into a convenient multipackage. Flexible ring carriers may include a handle that extends upwardly from the carrier to enable a consumer to carry the package from the top (called a "top lift carrier") or outwardly from a side of the carrier to enable a consumer to carry the package from the side (called a "side lift carrier").

Container carriers may also contain holes in a center void area among the container receiving apertures which may also be used to carry the package. However, these carrier holes are often too small, presenting difficulty for a consumer to insert his finger and thumb into the carrier holes to successfully carry the container. As such, a need arises for a container carrier with improved finger tabs for carrying the container carrier.

SUMMARY OF THE INVENTION

The present invention is directed to a finger tab container carrier for packaging containers that includes an arrangement of container receiving apertures that are configured to permit placement over containers and permit carrying a unitized package of containers with finger tabs in a center void area extending longitudinally along the inner center of the package.

The carrier is suitably configured with a combination of webs and container receiving apertures that permit opening up and generally even, distributed stretching for application to the containers. Traditional carriers typically include oval, round, rectangular or triangular shaped container receiving apertures.

This invention relates to an improved finger tab configuration by modifying the shape of finger tab holes to increase surface area. The finger tabs of the subject invention are rectangular in shape (versus diamond-shaped in previous versions) with convex segments protruding inward in the vertical plane of the container carrier. This allows flaps to develop to make carrying the container carrier much easier on a consumer's fingers.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

FIGS. 1-4B show a finger tab container carrier for unitizing multiple containers 102 into a resulting unitized multipackage. Although FIGS. 1-4B illustrate various structures for the finger tab container carrier 100 of the invention, the illustrations are exemplary, and the invention is not limited to the container carriers or multipackages shown for six containers. For example, the finger tab container carrier 100 may be alternatively configured and used to unitize ten, twelve, or any other desired number of containers.

Figure 1:
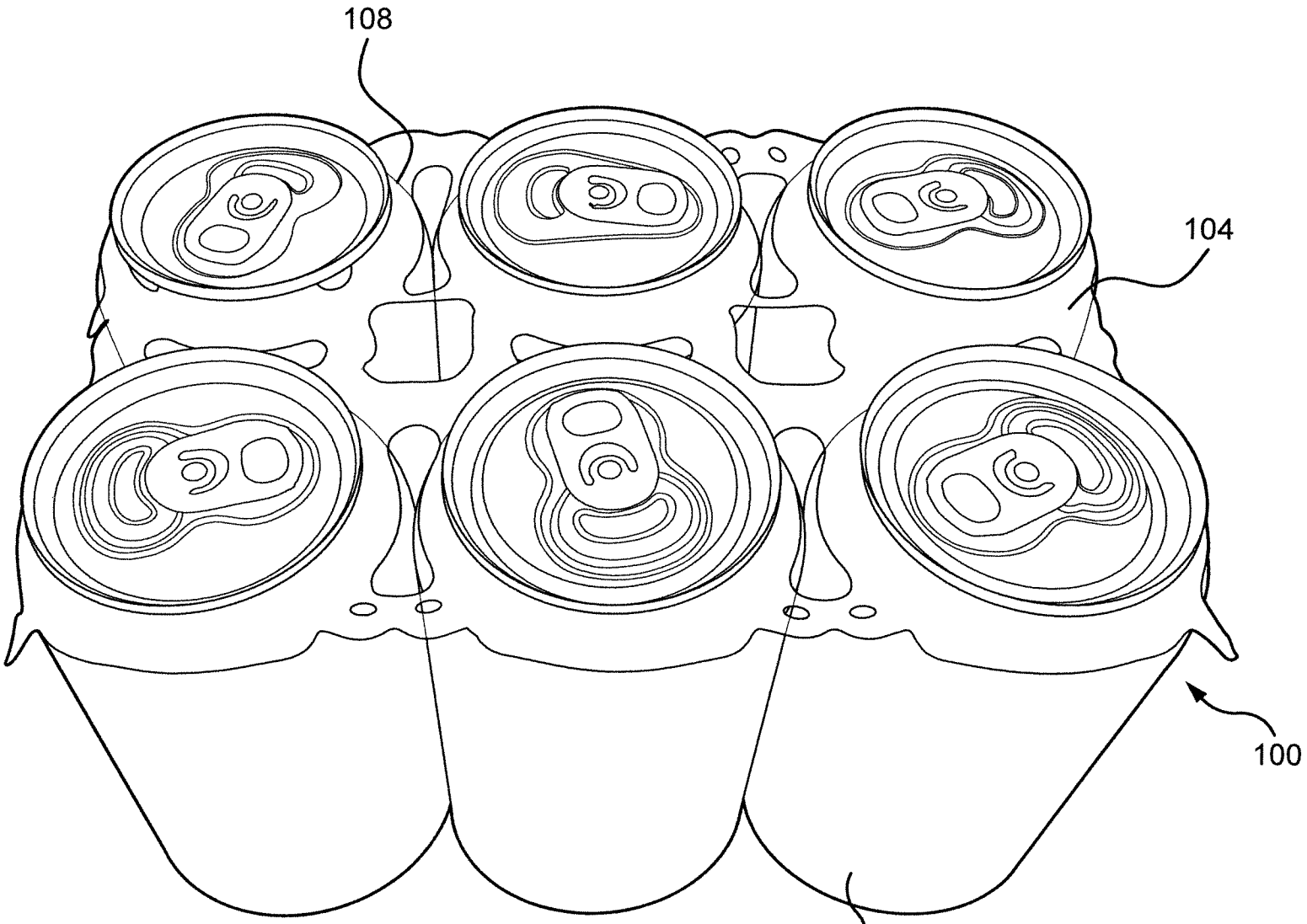
FIG. 1 is a front elevational view of a finger tab container carrier according to one preferred embodiment of this invention.
Figure 2:
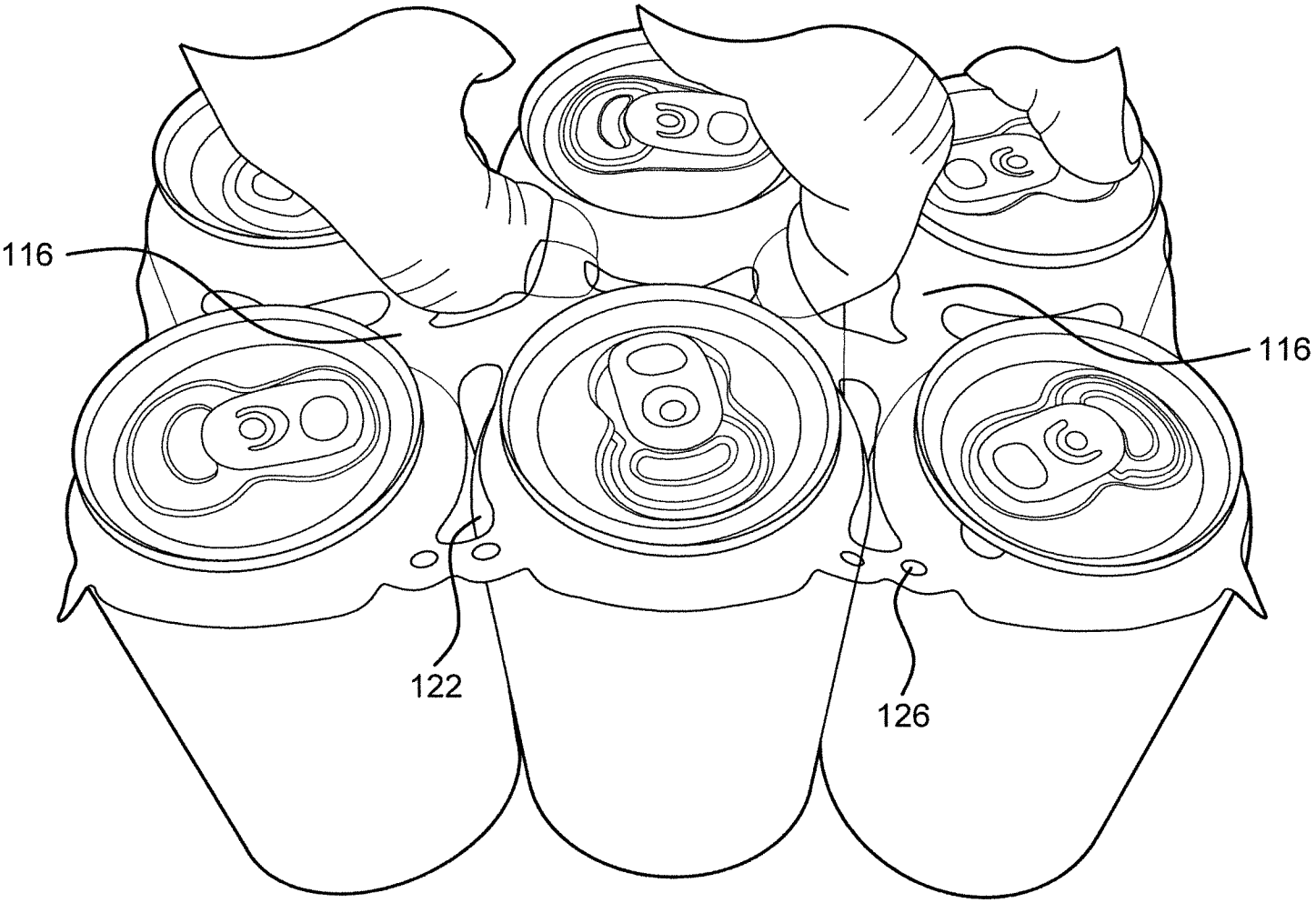
FIG. 2 is another front elevational view of the finger tab container carrier according to the embodiment of FIG. 1 with consumer use of the tabs.
Figure 3:
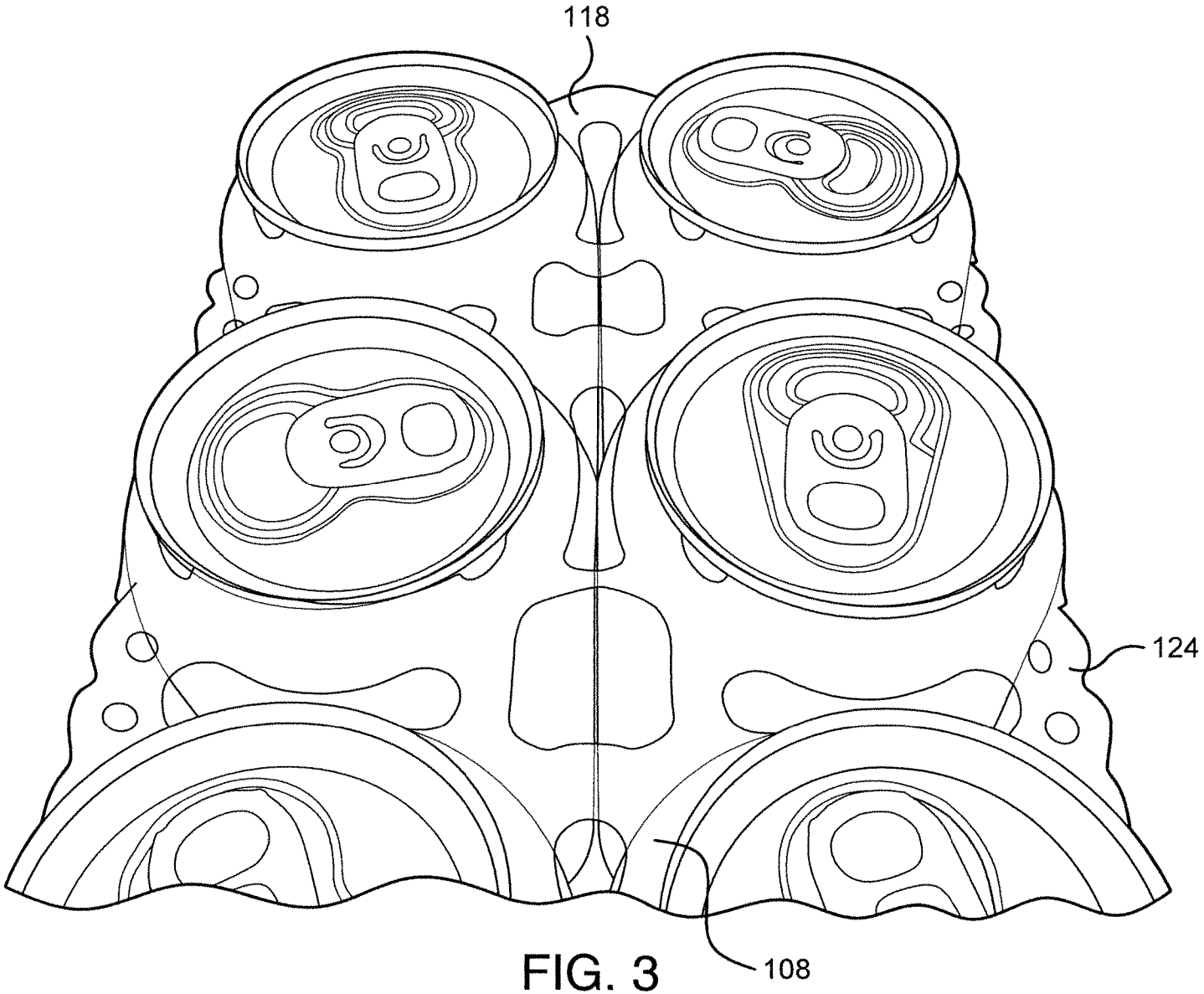
FIG. 3 is a partial side elevational view of the finger tab container carrier according to the embodiment of FIG. 1.

Containers 102 are preferably cans as shown in FIGS. 1-3, however bottles or any other commonly unitized container may be used with the finger tab container carrier 100 according to this invention. The containers 102 are preferably, though not necessarily, like-sized within a single finger tab container carrier 100.

Figure 4A:
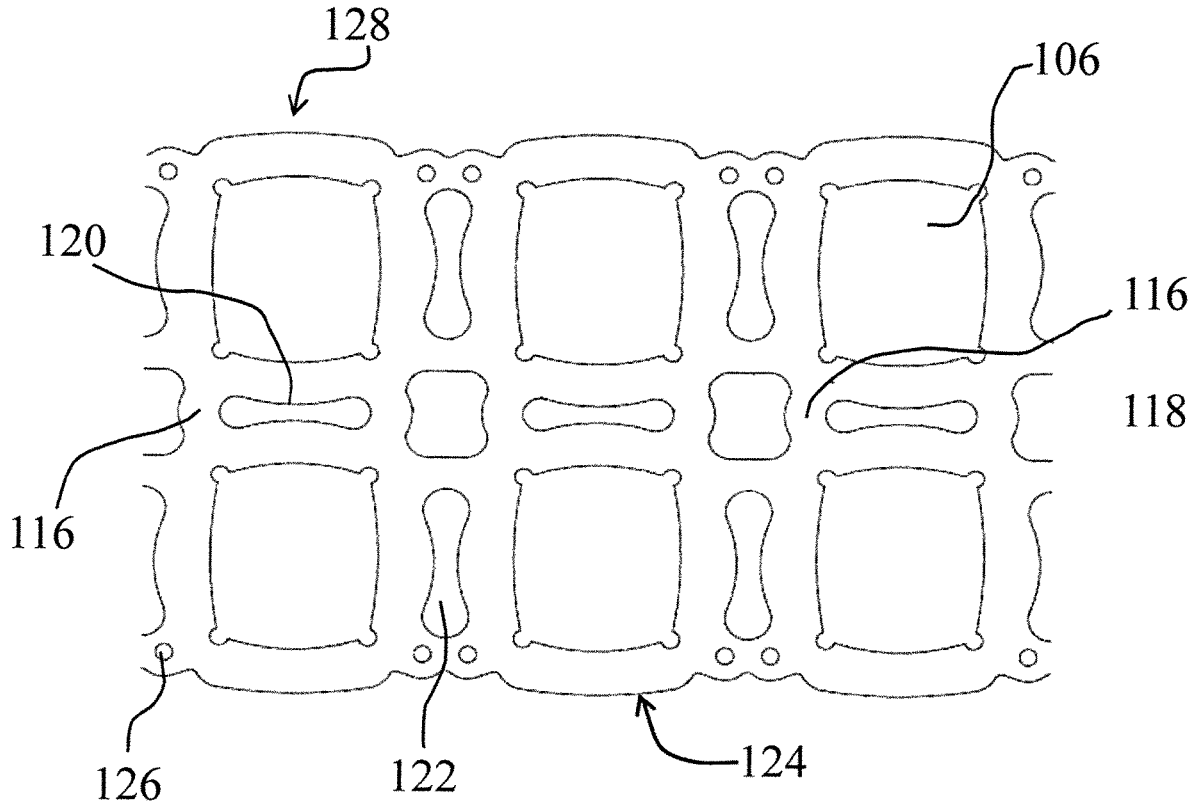
FIG. 4A is a perspective view of the finger tab container carrier according to another embodiment of the invention.

Each finger tab container carrier 100 preferably includes a single layer of flexible sheet having a width and length defining therein a plurality of flexible bands 104 further defining a plurality of container receiving apertures 106, each for receiving a container 102. The plurality of container receiving apertures 106 are preferably arranged in two longitudinal rows and multiple longitudinal ranks so as to form an array of container receiving apertures 106, such as two rows by three ranks for a six container multipackage as shown in FIGS. 1-3. Container receiving apertures 106 are preferably generally slightly elongated in a latitudinal direction of the finger tab container carrier 100, as shown in FIG. 4A. The container carrier 100 may also have a panel 124 along at least one of the longitudinal rows.

A representative multipackage resulting from the finger tab container carrier 100 includes a plurality of unitized containers 102, such as shown in FIGS. 1-3. The finger tab container carriers 100 are generally applied to containers 102 by stretching the flexible bands 104 surrounding the container receiving apertures 106 around each container, and requiring the stretched carrier to recover, thereby providing a tight engagement.

A preferred carrier configuration includes bands forming two distinct parallel rows of container receiving apertures 106. Each rank preferably includes two container receiving apertures 106 (one for each row in the carrier). Preferably, each of the carriers shown in FIGS. 1-4A are manufactured in a generally continuous string 128 of carriers wherein the carriers are punched or otherwise formed longitudinally adjacent to other carriers (as seen in FIG. 4A). In this manner, the continuous string 128 of carriers is formed that may be rolled onto reels or folded into boxes for later unwinding and application to containers 102. The carriers are then cut into individual carriers and formed into individual multipackages.

Figure 4B:
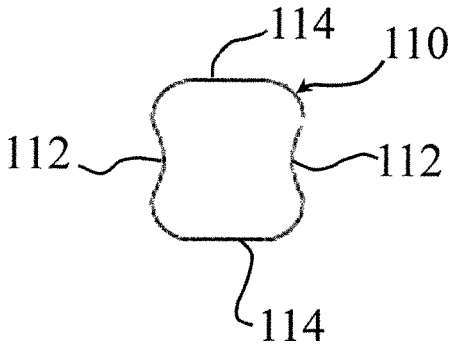
FIG. 4B is an enlarged perspective view of the intermediate aperture according to FIG. 4A.

As shown through the figures, container receiving apertures 106 and intermediate apertures 108 are preferably formed by bands in a geometry that results in a uniform application of the carrier 100 to containers 102 to produce a tight unitization of containers 102 within each finger tab container carrier 100. In particular, and as shown in the figures, the carrier preferably includes an intermediate aperture 108 formed in a primarily rectangular shape with two complimentary concave sides 112 opposite one another, and two straight sides 114. Further details of which are shown in FIG. 4B. As described, the intermediate aperture 108 is defined as an aperture positioned between both each transverse rank and each longitudinal row of container receiving apertures 106. Each side of each intermediate aperture 108 is preferably parallel to a portion of each adjacent container receiving aperture. A first side 114 of each intermediate aperture 108 is preferably the same length as a second side 114 of each intermediate aperture 108. A third side 112 of each intermediate aperture 108 is preferably the same length as a fourth side 112 of each intermediate aperture 108. In addition, each corner 110 of each intermediate aperture 108 preferably includes rounded corners 110. The third and fourth sides 112 of each intermediate aperture 108 are preferably concave mirror images of one another. The intermediate aperture 108 in the subject invention provides additional surface area and ease of use as compared to previous intermediate apertures that were formed in a diamond shape. The increase in surface area with the intermediate aperture 108 is substantial at nearly a 50% increase, though other amounts of increased surface are possible also.

According to one preferred embodiment, a bone-shaped aperture 118 with two concave sides 120 is positioned between each container receiving aperture in transverse ranks. Each of these transverse apertures 118 are preferably positioned midway between each adjacent container receiving aperture in transverse ranks. Each transverse aperture 118 is also preferably positioned midway between each adjacent intermediate aperture 108. As a result, the concave sides 112 of each intermediate aperture 108 result in convex tabs 116 between each transverse aperture 118 and intermediate aperture 108. As shown in FIG. 2, these convex tabs 116 may comprise a configuration that provides an ample area for a consumer to grasp by inserting a hand through the intermediate apertures 108 and still maintain the purpose and integrity of the multipackage. According to a preferred embodiment, a major axis of the transverse apertures 118 is preferably perpendicular to a major axis of additional bone-shaped longitudinal apertures 122. Each longitudinal aperture 122 is preferably positioned between each container receiving aperture in longitudinal ranks. As shown in FIG. 4A, the longitudinal apertures 122 are preferably wider than the transverse apertures 118.

As shown through the figures, the container carrier may comprise one or more circular apertures 126 positioned along outer perimeters or panels 124 of the container carrier. The circular apertures 126 may aid in application of the container carrier, in particular the container receiving apertures 106 of the container carrier, onto containers 102. The outer perimeters of the container carrier 100, such as the panel 124, may include merchandising information, proof of purchase information, pricing, scannable codes, marketing material and/or other designs and/or information relevant to the multipackage.

While in the foregoing specification this invention has been described in relation to certain preferred embodiments thereof, and many details have been set forth for purpose of illustration, it will be apparent to those skilled in the art that the finger tab container carrier is susceptible to additional embodiments and that certain of the details described herein can be varied considerably without departing from the basic principles of the invention.

The invention claimed is:

1. A container carrier for unitizing a plurality of containers comprising:

a plurality of flexible bands that form an array of container receiving apertures, the array arranged in longitudinal rows and transverse ranks; and a generally rectangularly shaped intermediate aperture formed between each pair of container receiving apertures, the intermediate aperture including rounded corners and two concave sides pinched inwardly toward a center of the intermediate aperture and two straight sides aligned generally parallel to a longitudinal direction of the container carrier, wherein the two concave sides and the two straight sides of each generally rectangularly shaped intermediate aperture form at least two convex tabs positioned between each container receiving aperture in transverse ranks.

2. The container carrier of claim 1 wherein the convex tabs are configured to carry the container carrier with the plurality of containers.

3. The container carrier of claim 1 further comprising a transverse aperture positioned between each container receiving aperture in transverse ranks.

4. The container carrier of claim 3 wherein each transverse aperture is positioned midway between each adjacent container receiving aperture in transverse ranks.

5. The container carrier of claim 4 wherein each transverse aperture further comprises two concave sides along a major axis of the aperture.

6. The container carrier of claim 5 wherein the two concave sides of each transverse aperture form a bone-shaped aperture.

7. The container carrier of claim 1 further comprising a longitudinal aperture positioned between each container receiving aperture in longitudinal ranks.

8. The container carrier of claim 7 wherein each longitudinal aperture is positioned midway between each adjacent container receiving aperture in longitudinal ranks.

9. The container carrier of claim 8 wherein the longitudinal apertures between longitudinal ranks of container receiving apertures are wider than transverse apertures between transverse ranks of container receiving apertures.

10. A finger tab container carrier for unitizing a plurality of containers comprising:

a plurality of flexible bands that form an array of container receiving apertures, the array arranged in longitudinal rows and transverse ranks;

an intermediate aperture formed between each pair of container receiving apertures, wherein at least two sides of each intermediate aperture are the same length and are parallel to a portion of an adjacent container receiving aperture, wherein each intermediate aperture comprises two concave sides wherein each concave side forms a convex segment protruding inward in a vertical plane of the carrier;

a transverse bone-shaped aperture positioned between each container receiving aperture in transverse ranks; and at least one end panel formed adjacent to the array of container receiving apertures.

11. The finger tab container carrier of claim 10 wherein the at least one end panel further comprises a plurality of circular apertures positioned between each adjacent carrier in a continuous string of carriers.

12. The finger tab container carrier of claim 10 further comprising two longitudinal apertures positioned between each adjacent carrier in the generally continuous string of carriers.

13. The finger tab container carrier of claim 12 wherein a major axis of each transverse aperture is perpendicular to a major axis of each longitudinal aperture.

14. The finger tab container carrier of claim 13 wherein the longitudinal apertures between longitudinal ranks of container receiving apertures are wider than the transverse apertures between transverse ranks of container receiving apertures.

15. The finger tab container carrier of claim 10 further comprising a plurality of adjacent container carriers formed in the continuous string.

* * * * *